US008884751B2

(12) United States Patent
Baldocchi et al.

(10) Patent No.: US 8,884,751 B2
(45) Date of Patent: Nov. 11, 2014

(54) PORTABLE MONITOR FOR ELDERLY/INFIRM INDIVIDUALS

(76) Inventors: Albert S. Baldocchi, Boulder, CO (US); David D. Minter, Littleton, CO (US)

( * ) Notice: Subject to any disclaimer, the term of this patent is extended or adjusted under 35 U.S.C. 154(b) by 304 days.

(21) Appl. No.: 13/175,160

(22) Filed: Jul. 1, 2011

(65) Prior Publication Data

US 2011/0291827 A1 Dec. 1, 2011

(51) Int. Cl.

| | |
|---|---|
| ***G08B 1/08*** | (2006.01) |
| ***G08B 23/00*** | (2006.01) |
| ***G08B 13/14*** | (2006.01) |
| ***G08B 21/00*** | (2006.01) |
| ***G08B 21/04*** | (2006.01) |
| ***G08B 25/08*** | (2006.01) |

(52) U.S. Cl.

CPC ..... *G08B 21/043* (2013.01); *G08B 21/0476* (2013.01); *G08B 25/08* (2013.01)

USPC ..... 340/539.11; 340/573.1; 340/572.1; 340/573.4; 340/666

(58) Field of Classification Search

CPC .. A61B 5/0022; A61B 5/02055; A61B 5/002; A61B 5/681; A61B 5/0024; A61B 5/0205; A61B 5/1112; A61B 5/7275; A61B 2019/448; A61B 5/165; A61B 5/6887; A61B 5/721; A61B 5/742; A61B 5/7465; A61B 2503/08; A61B 5/02438; A61B 5/0404; A61B 5/1113; A61B 5/1126; G06F 19/3418; G08B 21/0211; G08B 21/0453; G08B 25/016; G08B 13/19682; G08B 21/02; G08B 21/0446; G08B 23/00; G08B 21/0216; G08B 21/0469; G08B 21/0476; G08B 21/0484; G08B 21/12; G06Q 50/22

See application file for complete search history.

(56) References Cited

U.S. PATENT DOCUMENTS

| | | | | |
|---|---|---|---|---|
| 5,544,661 | A * | 8/1996 | Davis et al. | 600/513 |
| 6,078,261 | A * | 6/2000 | Davsko | 340/573.4 |
| 6,359,557 | B2 * | 3/2002 | Bilder | 340/531 |
| 6,997,882 | B1 | 2/2006 | Parker et al. | |
| 7,113,090 | B1 * | 9/2006 | Saylor et al. | 340/539.18 |
| 7,400,257 | B2 | 7/2008 | Rivas | |
| 8,299,919 | B2 * | 10/2012 | Dayton et al. | 340/539.14 |
| 2003/0125612 | A1 * | 7/2003 | Fox et al. | 600/347 |
| 2004/0030531 | A1 * | 2/2004 | Miller et al. | 702/182 |

(Continued)

FOREIGN PATENT DOCUMENTS

WO WO 2010111138 A1 * 9/2010

*Primary Examiner* — Daniel Wu
*Assistant Examiner* — Emily C Terrell
(74) *Attorney, Agent, or Firm* — Christopher J. Kulish

(57) ABSTRACT

The present invention is directed to a portable monitor for use by elderly/infirm individuals that desires a significant degree of independence but recognizes that their ability to handle many situations by themselves is or will become substantially attenuated. In one embodiment, the portable monitor includes: (a) a sensor system that receives data reflecting environmental and personal aspects associated with the monitored individual from various sensors, (b) a user interface that allows the monitored individual to interact with the monitor; (c) a communication interface that provides for the ability to communicate with a third party if the monitored individual is or is likely to enter into a situation in which assistance is likely needed; and (d) a processing system for processes data produced by sensor system and data input from the user interface to determine if the monitored individual is in a situation or likely is in a situation in which assistance is likely needed.

10 Claims, 1 Drawing Sheet

(56) References Cited

U.S. PATENT DOCUMENTS

| | | | | |
|---|---|---|---|---|
| 2006/0089542 | A1 | 4/2006 | Sands | |
| 2007/0106124 | A1* | 5/2007 | Kuriyama et al. | 600/300 |
| 2008/0001735 | A1* | 1/2008 | Tran | 340/539.22 |
| 2008/0005301 | A1 | 1/2008 | Li et al. | |
| 2008/0294462 | A1* | 11/2008 | Nuhaan et al. | 705/3 |
| 2010/0145234 | A1* | 6/2010 | Jang et al. | 600/595 |
| 2010/0302043 | A1* | 12/2010 | Skubic et al. | 340/573.1 |
| 2011/0016064 | A1 | 1/2011 | Barton | |

* cited by examiner

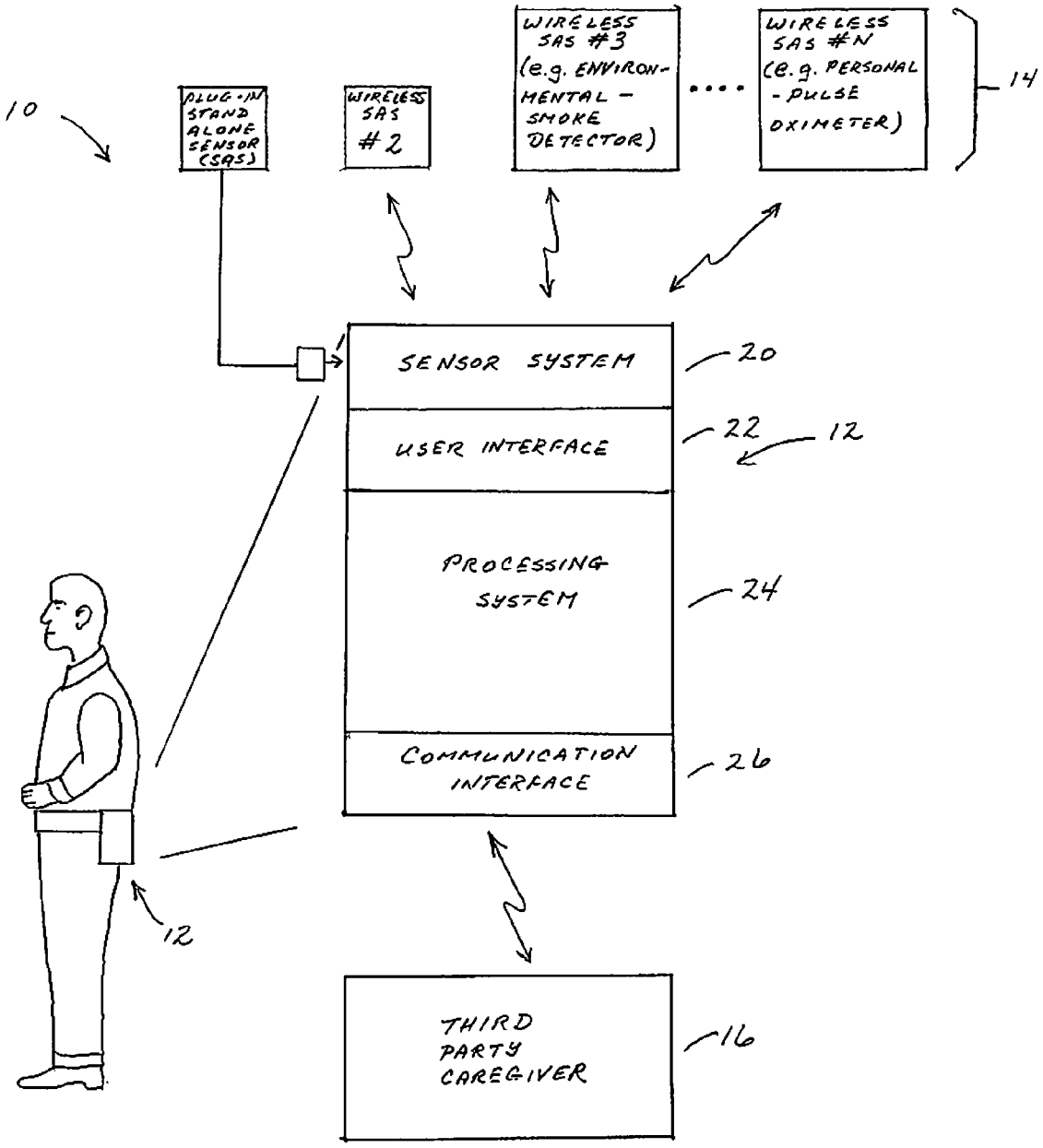
10
PLUG-IN STAND ALONE SENSOR (SAS)
WIRELESS SAS #2
WIRELESS SAS #3 (e.g. ENVIRONMENTAL - SMOKE DETECTOR)
WIRELESS SAS #N (e.g. PERSONAL - PULSE OXIMETER)
14
SENSOR SYSTEM
20
USER INTERFACE
22
12
PROCESSING SYSTEM
24
COMMUNICATION INTERFACE
26
12
THIRD PARTY CAREGIVER
16

PORTABLE MONITOR FOR ELDERLY/INFIRM INDIVIDUALS

FIELD OF THE INVENTION

The present invention relates to a portable monitor for use by elderly or infirm individuals that is used in identifying situations in which the individual will likely need assistance.

BACKGROUND OF THE INVENTION

In the US and other countries, longer life spans, the aging of the population, and the increasing cost of medical care especially in the last years of life, has produced much interest in new approaches to improving the quality of late-life years and reducing costs of late-life care. Presently, there are several portable devices that allow an individual to call for help. In using such a device, the individual must recognize that he/she is in a situation in which help is liked to be needed or such a situation is imminent. Further, the individual must not only recognize that he/she is in such a situation or such a situation is imminent, the individual must also be capable of using the device to call for help and use the device to call for help. There are other portable devices that are capable of receiving radio signals from multiple medical monitors with each radio signal providing data relating to a particular physiological parameter of the individual and transmitting the data to a centralized location. Also known are other devices (not necessarily portable devices) that monitor rooms for unusual movement, that attach to a patient to evaluate motion of a body, that locate an elderly person who may have wandered, or perform other specific functions.

SUMMARY OF THE INVENTION

While the known portable monitors for use by elderly or infirm individuals likely provide valued functions, their ability to improve such an individual's quality of life is limited. More specifically, the known portable monitors are not specifically designed to provide an elderly/infirm individual that desires a significant degree of independence but recognizes that their ability to handle many situations is or will become substantially attenuated with the ability to meaningfully increase the period of time during which their independence can be retained. The present invention is capable of providing a more complete picture of an elderly/infirm individual's life situation, thus enabling the detection of potentially dangerous situations earlier and the initiation of more timely and appropriate action to address such situations. This, in turn, reduces the cost of care and allows an individual to improve their quality of life.

The monitoring device of the present invention is a portable device, i.e., a device that can be carried on or associated with the person of a typical elderly/infirm individual without substantially impeding the individual's ability to move. In one embodiment, the monitoring device has a weight and dimensions comparable to those of current cellular telephones. Generally, the monitoring device includes a sensor system, a user interface, a processing system, and a communication interface for wireless communication of data relating to the monitored individual to a third party.

The sensor system is capable of receiving wireless signals from environmental sensors that are associated with one or more environments in which the monitored individual is found. In this regard, the present invention recognizes that elderly/infirm individuals that desire a significant degree of independence typically moves been several different environments. For instance, such an individual may spend significant periods of time in their residence, in an area surrounding their residence, in a car or other personal mobility device (e.g., electric chair), in various shopping centers or stores, and in cabs or buses, to name a few environments. In many cases, the sensors that provide radio signals to the sensor system will be sensors that are associated with the possessions of the monitored individual. For instance, a sensor can be associated with a stove to indicate that a stove burner has been activated and whether or not there is a flame associated with the activated burner. Other wireless sensors may be associated with public venues and/or public transportation and provide signals that can be received by the device. In one embodiment, the sensor system is additionally capable of accommodating a sensor that provides a signal to the sensor system via a cable, such as a USB cable. For example, the sensor system can receive a signal via an electrically conductive cable from a sensor that measures the monitored individual's blood sugar. In yet another embodiment, the sensor system additionally includes sensors that are integrated into the device. For example, the sensor system can include a camera, a camera and a QR code scanner application, an RFID reader, a GPS receiver, and/or microphone, to name a few devices that function or are capable of functioning as sensors.

The user interface allows the monitored elderly/infirm individual to interact with the device. The user interface includes at least one input peripheral and perhaps several input peripherals that each provides the individual with the ability to input data or information into the device. Examples of input peripherals include the "touch" portion of a touch screen, a keyboard, a trackball, a camera, or a microphone to name a few. It should be appreciated that many types of input peripherals may also function as sensors that are part of an embodiment of the sensor system. The user interface also includes at least one output peripheral and perhaps several output peripherals that each provides data and/or information to the monitored individual. Examples of output peripherals include a monitor, one or more LED lights, a vibrator that causes the remainder of the device to vibrate, and a speaker to name a few.

The processing system processes data produced by the sensor system and input data/information from the input peripheral(s). The processing system includes a processor and memory for storing data relating to the monitored individual and one or more programs that are each capable of being used in the monitoring of the elderly/infirm individual. The processing system processes data produced by or derived from one or more of the sensors, the data including current data (i.e., the most recent data produced by one or more sensors) and/or historical data. In one embodiment, the processing system processes data to determine if the elderly/infirm individual is in a situation or likely is in a situation in which the individual would likely need the assistance of another individual. If the processing system determines that the probability that the monitored individual is likely to need assistance does not meet or exceed a threshold value, the processing system does not undertake any action. If, however, the determined probability meets or exceeds the threshold value, the processing system initiates a call for assistance via the communication interface. In another embodiment, if the determined probability meets or exceeds the threshold, the processing system initially employs the user interface to contact the monitored individual and obtain the monitored individual's input as to whether or not assistance is needed. Depending upon the input or lack of input provided by the monitored individual and/or other factors (e.g., the determined probability and the type of situation potentially being encountered by the individual), the processing system determines whether or not to call for assistance using the communication interface.

In one embodiment of the monitoring device, the monitored individual is provided with a significant amount of control as to their privacy. To elaborate, the device allows the monitored individual to interact with the device via the user interface to prevent the sensor system from acquiring data from any sensors that are used for the purpose of monitoring the individual and conveying any sensor data or information derived from sensor data to the third party caregiver. Consequently, should the monitored individual want to not be monitored for a certain amount of time, the monitored individual can place the monitoring device in a state that terminates substantially all of the monitoring related functions. In another embodiment, the monitored individual is provided with increased selectivity regarding the monitoring done by the device. In this embodiment, the monitoring device allows the monitored individual to interact with the device via the user interface to: (a) turn "off" a selected sensor to the extent the sensor provides such functionality, (b) allow data from a selected sensor to be received by the monitor but not processed by the monitor, or (c) allow data from a selected sensor to be received and processed by the monitor but prevent any of the data or information derived from the data to be conveyed to the a third party caregiver.

BRIEF DESCRIPTION OF THE DRAWINGS

FIG. 1 illustrates an embodiment of a monitoring system for use by elderly/infirm individuals that is comprised of multiple sensors, a portable monitor, and a third party communication apparatus.

DETAILED DESCRIPTION

With reference to FIG. 1, an embodiment of a monitoring system for use by an elderly/infirm individual (hereinafter system 10) is described. Generally, the system 10 is comprised of: (a) a portable monitor 12 for associating with a monitored elderly/infirm individual, the monitor including a user interface that allows the monitored individual to interact with the monitor 12, (b) multiple stand-alone sensors 14 that each sense an environmental parameter associated with an environment that the monitored individual occupies on occasion or a personal parameter associated with the monitored individual and that provide data/information to the portable monitor 12, and (c) a third party communication apparatus 16. Generally, the portable monitor 12 process data provided by the stand-alone sensors 14 and any sensors that are integrated into the monitor 12 and data/information received by the user interface in connection with determining if the monitored individual is in a situation or likely is in a situation in which the individual would likely need the assistance of another individual. If such a situation is likely, the system 10 initiates the appropriate response. The appropriate response can take a number of forms. For instance, the system 10 can be used to summon help. Alternatively, the system 10 can initially communicate with the monitored individual using the monitor 12 to obtain the monitored individual's input as to whether he/she is aware of the likely situation and is currently of the view that he/she can adequately address the situation without the aid of a third party. Depending on the monitored individual response or lack of response, the system 10 either continues to monitor the individual or summons help.

With continuing reference to FIG. 1, the multiple stand-alone sensors 14 are described. The multiple stand-alone sensors generally are of two types. The first type is a wireless sensor that senses an environmental parameter of an environment in which the monitored individual resides or a parameter that is personal to the monitored individual and provides data representative of the environmental or personal parameter to the monitor 12 via a wireless or radio signal. In one embodiment, the wireless signal conforms to the Bluetooth standard. The second type of stand-alone sensor requires that the sensor be physically connected by a cable to the monitor to transfer data on the sensed parameter to the monitor 12. Examples of the types of cables that can be used to transmit data include electrical cables (e.g., USB) and optical cables.

The stand-alone sensors that are used to sense parameters associated with an environment of a monitored individual can take many forms. Examples of environmental sensors include: a smoke detector, a cooking appliance sensor (e.g., on/off, "on" for how long, "on" and burner unlit etc.), refrigerator sensor (door open/closed, weight of contents increasing/decreasing), motion sensor, thermometer for interior of residence, carbon monoxide sensor, water tap sensor (on/off, on for how long), camera, video recorder, microphone, automobile sensors to determine if the engine is running, the amount of gasoline in the tank or charge remaining in the battery system, the speed of the automobile, the direction in which the automobile is moving etc. to name a few. Many other types of stand-alone environmental sensors are feasible.

The stand-alone sensors that are used to sense parameters that are personal to the monitored individual can also take many forms. Examples of sensors that sense parameters associated with a monitored individual include a biometric sensor (e.g., fingerprint and iris pattern), GPS sensor, body position (e.g., standing, lying down etc.), breath analyzer, blood sugar analyzer, body temperature thermometer, blood pressure cuff, pulse sensor, blood oximeter sensor, camera, video recorder, microphone to name a few. As with stand-alone environmental sensors, many other types of stand-alone sensors for sensing parameters associated with a monitored individual are feasible.

The portable monitor 12 includes a sensor system 20, a user interface 22, a processing system 24, and a communication interface 26. The sensor system 20 is capable of receiving data/information from a wireless stand-alone sensor and a cabled stand-alone sensor. With respect to wireless stand-alone sensors, the sensor system 20 employs a single antenna-receiver that is capable of communicating with one wireless stand-alone sensor at a time. As such, the sensor system 20 is operated so as to transfer data from the wireless stand-alone sensors one at a time. It should be appreciated that the monitor and wireless stand-alone sensors can be adapted to implement parallel channels that allow simultaneous communications from multiple wireless stand-alone sensors. However, such an adaptation is likely to add significant complexity to the monitor. As to cabled stand-alone sensors, the sensor system 20 provide a single port for establishing a connection between the monitor 12 and the cable associated with a particular type of cabled stand-alone sensor (e.g., USB). The monitor 12 can be adapted to include multiple ports. In the case of multiple ports, there can be a variety of different ports. For example, one port can be a USB port and another port can be an IrDA port. The sensor system 20 also includes integrated sensors, i.e., sensors that are built into the monitor 12 and as such do not need to transmit data to the monitor 12 via a wireless communication link or transmit data to the monitor 12 via a cable. Integrated sensors that are or can be part of the sensor system 20 include a camera, a microphone, a keyboard, the "touch" portion of a touch screen, and a trackball to name a few. Further, many of the sensors can function as either an environmental sensor or a personal sensor. For example, a camera can serve to take a picture that can be analyzed to determine if there is smoke in the environment in which the monitored individual is currently residing and can also serve to take a picture of an injury sustained by the monitored individual. Generally, the sensor system 20 operates to service each of the sensors that are being used to monitor an individual in a predetermined sequence that may result in a particular sensor being service many times to another sensor being served only once and that may also accommodate interrupts in which a particular sensor is prioritized relative to the other sensors and serviced out of sequence.

Clearly, many different types of sensors, stand-alone and integrated, can be associated with a monitored individual. However, the types of sensors associated with a particular monitored individual are chosen based upon the types of situations that the individual could face in the various environments in which the individual resides and that may require the assistance of a third party. For instance, in a residential environment, common situations in which an elderly/infirm individual may need assistance from a third party are a fire, a carbon monoxide leak, and the environment being too hot or too cold. With respect to these kinds of situations, the sensors employed might include door sensors and a biometric sensor to determine when the monitored individual has entered the residential environment and, with respect to the fire situation, a smoke detector, cooking appliance sensors, and a camera or video recorder. Depending of the specific situation of the monitored individual a different set of sensors or additional sensors may be appropriate.

The user interface 22 includes at least one input peripheral that allows the monitored individual to interact with the monitor 12 and at least one output peripheral that allows the monitor 12 to provide the individual with data/information. Many types of input peripherals are feasible, including the "touch" portion of a touch screen, a keyboard, a trackball, a microphone, and a camera to name a few. It should be appreciated that several input peripherals that allow the monitored individual to interact with the monitor 12 can also serve as an environmental and/or personal sensor. Many types of output peripherals are also feasible, including a monitor, one or more LEDs, and a speaker to name a few. The user interface 22 can also be used by individuals other than the monitored individual to interact with the monitor 12. In this regard, a caregiver can use the interface to provide data/information to the monitor 12. Alternatively, the user interface 22 can be accessed by the third party caregiver 16 using the communication interface 26. This allows an operator associated with the third party caregiver 16 to interact with the monitor 12. For example, if the monitored individual is incapable of using the user interface 22 to interact with the monitor 12 to adjust a parameter used by a program that is part of the processing system 24 or to load an "app" associated with a sensor that is being added to the system 10, the third party caregiver 16 allows an operator associated with the caregiver to interact with the monitor to take the necessary action.

The processing system 24 processes the data/information produced by the sensor system 20 and data/information produced by the input peripheral(s) of the user interface 22. The processing system 24 includes a processor and memory for storing data relating to the monitored individual and one or more programs that are each capable of being used in the monitoring of the elderly/infirm individual. In contributing to the determination of whether the monitored individual is in a situation or likely is in a situation in which the individual likely needs assistance, the processing system 24 processes data/information produced by or derived from one or more of the sensors. The sensors include the stand-alone sensors 14 and sensors integrated into the monitor 12, which can include devices that are associated with the user interface 22. In one embodiment, the processing system 24 determines whether the monitored individual is in a situation or likely is in a situation requiring assistance. This determination is a probabilistic determination and, depending on the monitored individual's life situation and the sensors being employed, may involve the use of artificial intelligence, voice analysis, and pattern recognition technologies to name a few. Further, the determination involves, not only determining the probability of the monitored individual being in a situation that likely requires assistance, but also a comparison of the determined probability to a threshold. If the calculated probability does not meet or exceed the specified threshold, the processing system 24 takes no further action at that time. However, the monitoring of the individual continues and action may be taken in the future. If the calculated probability meets or exceeds the specified threshold, the processing system 24 initiates action.

In one embodiment, the action taken by the processing system 24 is the use of the communication interface 26, which implements a wireless communication protocol, to issue a call for assistance to the third party caregiver 16. In one embodiment, the wireless communication protocol is a cell phone protocol (e.g., UMTS, IS-95, GSM, CDMA-2000 etc.) The call for assistance can take many forms. In one embodiment, the call sets forth the monitored individual's name, the individual's location, and the situation being faced by the monitored individual (e.g., a fire). The inclusion of different or additional information is feasible. In one embodiment, the call is in the form of a text message. However, other formats, like a simulated voice, are also feasible. The third party caregiver 16 can also take many forms. For instance, the third party caregiver 16 can be centralized processing facility that processes the call for assistance to determine who the appropriate entities are to respond. For example, if the call indicates that the monitored individual is facing a fire, the facility would initiate a call to the appropriate fire department and, perhaps, one or more of the monitored individual's relatives or friends. Alternatively, the monitor 12 has contact information for the third party caregiver that is the appropriate responder and places the call directly to the caregiver. In this instance and continuing with the fire example, the local fire department is the third party caregiver 16 and the monitor 12 places the call for assistance directly with the local fire department. The third party caregiver 16 can also be multiple separate entities. Continuing with the fire example, the monitor 12 could place a call for assistance to the local fire department and to the one of more of the monitored individual's relatives.

In another embodiment, the action taken by the processing system 24 in response to the calculated probability meeting or exceeding a threshold is the use of the user interface 22 to initially communicate with the monitored individual to assess whether the monitored individual is aware of the situation or potential situation and whether the monitored individual believes he/she is capable of addressing the situation without assistance. Depending of the response or lack of response by the monitored individual, the processing system 24 either takes no action at that time or proceeds to issue a call for assistance using the communication interface 26.

In situations in which the processing system 24 is not capable of performing all or a portion of the processing of the sensor data to make a determination of whether or not the monitored individual is in a situation or likely in a situation requiring assistance, the processing can be shared with the third party caregiver 16. In this case, the third party caregiver 16 is capable of performing all or a portion of the processing of the sensor data. As such, the third party caregiver 16 includes a processor and memory. When the third party caregiver 16 performs all or substantially all of the processing, the processing system 24 of the monitor 12 substantially functions so as to transfer sensor data to the third party caregiver 16 via the communication interface 16 and, if needed, the processing system 24 also communicates with the monitored individual via the user interface 22. In the situation in which the monitor 12 and the third party caregiver 16 share the processing of the sensor data, there are many possibilities. For example, the monitor 12 can do "front end" or less sophisticated processing of the sensor data and then hand-off further processing to the third party caregiver 16 for more advanced or sophisticated processing, such as artificial intelligence processing, pattern recognition, and speech recognition.

In situations in which the memory associated with the processing system 24 is inadequate or insufficient for performing the processing of the sensor data to make the determination as to whether or not the monitored individual is in a situation or likely in a situation requiring, memory associated with the third party caregiver 16 can be employed. In this case, the third party caregiver 16 has memory that can be or is allocated for use by the monitor 12. For example, the processing system 24 may not be able to store a significant amount of historical data (i.e., data that is older than the current data from a sensor) from one or more of the sensors and a particular analysis to make a determination may require significant historical data. In such a situation, historical data may be transferred from the monitor 12 to the third party caregiver 16 and subsequently recalled from the third party caregiver 16 when needed for the analysis. As another example, the memory associated with the processing system 24 may not be able to store a significant amount of historical data that is derived from individuals other than the monitored individual or that cannot be transferred from the third party caregiver 16 to the monitor 12 due to proprietary restrictions but may be useful in an assessment relating to the monitored individual. In this case, the data relating to other individuals and some or all of the processing may be done by the third party caregiver 16 and a result/assessment provided to the monitor 12.

It should be appreciated that a substantial portion of the components present in many of the current cellular telephones can function or are capable of being adapted to function as the components associated with the monitor 12. Specifically, many of the current cellular telephones have a user interface (e.g., a touch screen), a processing system, and a communication interface that provides the ability to conduct cellular telephone communications that can respectively function or be adapted to function as the user interface 22, processing system 24, and communication interface 26 of the monitor. Further, many current cellular telephones provide Bluetooth capability for short-range wireless communications with various devices. This Bluetooth capability is capable of functioning or being adapted to function for communications with wireless sensor devices. As such, it should be appreciated that the monitor 12 can be integrated into a cellular telephone, thereby providing a monitored individual with the monitoring capabilities of the monitor 12 and the various other capabilities provided by a cellular telephone.

The operation of the portable monitor 12 is now described. Initially, an evaluation is made of the individual that is to be monitored to identify the environment(s) in which the individual resides and the types of situations in which the individual is likely to need assistance. This evaluation, in turn, is used to identify the sensors that are needed to provide the data upon which determinations as to whether the monitored individual needs assistance can be based. In this regard, the stand-alone sensors must be compatible with the sensor system 20 of the monitor. For example, if the sensor system only accommodates cabled stand-alone sensors that utilize a USB cable, cabled stand-alone sensors that utilize other types of cables are necessarily foreclosed from consideration. In the case of wireless stand-alone sensors, if the sensor system 20 is for example limited to communications with one sensor at a time, communications conducted in a particular frequency band, and communications done according to a particular modulation technique, then sensors that do not meet these criteria are foreclosed from consideration. Since it is expected that the sensors will be manufactured by various manufacturers, standardization of the much of the sensor operation, including the manner in which the sensors communicate with the portable monitor 12, is anticipated. If standardization does occur, this is likely to both increase the sensor options for the monitored individual and reduce the complexity of the monitor 12.

Once the environments for the individual have been identified and sensors selected, the environments and the sensors associated with each of the environments are identified to the portable monitor 12. In one embodiment, the identification of the environments and sensors is done by executing a setup program on a PC, laptop, or other computing device (typically, with a relatively large display) and downloading the setup information to the monitor 12 via a USB cable. With respect to the environments, there are several ways to identify a particular environment. For example, one or more sensors can identify a residential environment. To elaborate, in a residence with the only normal points of ingress and egress being doors, sensors that sense the opening/closing of doors can define the residential environment. As an aside, a camera or video recorder coupled with a facial recognition program can be used to assess whether the monitored individual is entering or leaving the residential environment. Another way to identify an environment is using geo-locations. For example, an environment can be specified by identifying a particular latitude and longitude as the center of a circle with a defined radius. An environment can also be identified by using three or more geo-locations to identify an enclosed area. Environments that are not fixed typically are defined by the sensors associated with the environment. For instance, an automobile can be defined by the sensors associated with the automobile. An identifier that is associated with each of the sensors and facilitates communications with the monitor 12 is also recorded during setup. In this regard, some sensors may have a permanent identification number and other sensors may employ switches or other structures that allow an identifier to be associated with the sensor. Typically, each sensor in an environment has a unique identifier.

Also, as part of setup, an application program is associated with each of the sensors that at least specifies how to decode or interpret the data provided by the sensor. For example, an application program for a temperature sensor may specify how a 16-bit word that is output by the sensor is to be decoded or interpreted to reveal the sensed temperature. The application program may specify considerably more information that is needed or useful to the portable monitor 12 in communicating with the sensor. Typically, the application program for a sensor is set forth on media (e.g., CD) that accompanies the sensor or is downloaded over the Internet. Other modes of providing the application program are also feasible.

Setup also involves identifying the program or programs that are to be used to determine if the monitored individual is in a situation or likely is in a situation in which assistance is needed. Generally, there is a program for each type of situation. Common programs include fire, carbon monoxide leak, gas leak, residential interior is too hot or too cold. Many other programs are also feasible, including programs to assess caloric intake, social interaction, vehicle problems, and deviations from routine movements to name a few. Generally, the environment(s) and sensor(s) associated with each of the environments that the program is to monitor are identified to the program. Typically, a program is built to accommodate data from many types of sensors, each of which potentially providing data/information relevant to assessing the particular situation that the program addresses. The identification of the sensors in an environment allows the program to be tailored to the particular situation. For example, if a fire program is capable of evaluating data from a camera, smoke detector, stove, oven, furnace, and fireplace but a particular environment of the monitored individual only has a camera and smoke detector, the program adjusts so as to be able to generate a probability determination based on data from only the camera and smoke detector. Further, with respect to each of the selected programs, a threshold value is selected. For example, a threshold value of 35% might be selected for a fire situation when the monitored individual is a relatively old individual with limited mobility. Whereas, a threshold value of 50% might be more appropriate for a younger individual with greater mobility.

Also part of the setup is the identification of the third party caregiver 16. The third party caregiver can take on many forms. Consequently, the setup allows one of a number of forms for the third party caregiver 16 to be specified and requests the relevant information for the selected third party caregiver 16. For example, if the third party caregiver is an individual, the setup routine requests the contact information for that individual and the form of contact required by that individual (email, text messaging, voice etc.). In contrast, if the third party caregiver 16 is an automated processing station, the setup routine could request contact information and information relating to the manner in which the automated processing station requires information relating to the monitored individual to be transferred (e.g., encrypted).

Upon completion of the setup, the setup information and selected program are downloaded to the portable monitor 12. Typically, the download is accomplished using a port, such as a USB port, associated with the monitor 12. Other methodologies for loading the setup information and selected programs are also feasible. It should also be noted that the setup is likely to be done by an appropriately skilled and/or trained individual in consultation with the monitored individual's physician or other appropriate caregiver. It is, however, conceivable that the monitored individual could accomplish the setup on their own. Further, the installation or activation of sensors is also likely to be accomplished by appropriately skilled and/or trained individuals.

In operation, the monitor 12 acquires data from the sensors in the environment in which the monitored individual is currently situated or believed to be situated. Each of the programs that is assigned to that particular environment is provided with the data from the relevant sensors and evaluates the data. Provided the monitor 12 has not been deactivated, the assessment of data by the program(s) is continuous. If a particular program determines that the defined threshold value has been exceeded, appropriate action is initiated. Depending upon the monitor 12, appropriate action can be: (1) the placing of a call for assistance or (2) attempting to communicate with the monitored individual to assess whether the individual is aware of the situation or potential situation and whether the individual is of the view that no assistance is yet required and, depending on the response, either continuing to monitor the situation or placing a call for assistance.

The monitor 12 also provides the monitored individual with the ability to control the operation of the monitor in a manner that provides the monitored individual with significant control over their privacy. Specifically, the monitor 12 is provided with an on/off switch that allows the monitored individual to activate and deactivate the monitor. When the monitor 12 is in the "off" state, the monitor 12 cannot acquire data from any of the sensors in the system 10 and cannot convey any data from any of the sensors in the system or derived from sensors in the system to the third party caregiver 16. In addition, the monitored individual is provided with the ability to activate and deactivate, via the user interface 22, the processing of the data from one or more sensors by the sensor system 20 and/or programs. To elaborate, the monitored individual is provided with the options of (a) deactivating/activating a selected sensor (provided the sensor allows for deactivation/activation by the monitor), (b) allowing data from a selected sensor to be received by the sensor system 20 but not processed, or (c) allowing data from a selected sensor to be received by the sensor system 20 and processed by the processing system 24 but no data from the sensor or derived from the sensor data is conveyed to the third party caregiver 16. With respect to options (b) and (c), the monitor 12 allows the monitored individual to "undo" the selection of these options so that data from a selected sensor can be received, processed, and the data or information derived from the data provided to the third party caregiver 16 if needed. Further, with respect to options (b) and (c), the monitor 12 can store data received from the selected sensor and any data/information derived from the processing of the data from the selected sensor for use upon the cancellation of the selected option. For instance, if there are audio and video sensors in an environment, there is a program active in the monitor 12 that monitors the individual's social interactions, and the monitored individual desires privacy for a sensitive meeting with a family member, the monitored individual can deactivate the processing of data from the audio and video sensors and/or the social interaction program for the duration of the meeting. In one embodiment, the monitor 12 implements a timeout function that, upon the expiration of a timer, causes an inquiry to be displayed on the output peripheral of the user interface 22 of the monitor 12 as to whether the current deactivations are to be maintained. If the monitored individual either fails to reply or replies that the deactivations can be terminated, the monitor 12 re-enables the deactivated elements.

The following sets forth a number of examples of the use of the monitor 12 in assessing whether a monitored individual is in a situation or likely is in a situation in which assistance is likely needed:

Example 1

Assess whether the nutritional level for monitored individual is sufficient to maintain a desired activity level. The personal sensors employed with the monitored individual include: (a) a hand-to-mouth motion sensor that identifies hand-to-mouth movements and when each movement occurred (such a sensor assumes that a certain percentage of hand-to-mouth movements at particular times relate to the intake of food and/or water) and (b) a "Douglas Bag" sensor for providing an analysis of the monitored individual's breath and when the analyzed breath occurred ("Douglas Bag" breath analysis is used to assess caloric needs and/or caloric expenditures of a monitored individual). The environmental sensors employed in connection with the monitored individual include: (a) refrigerators sensors for determining if a refrigerator door has been opened/closed and when the door was opened/closed and/or increases/decreases in the weight of the refrigerator and contents of the refrigerator and when each increase/decrease occurred and (b) an RFID sensor in the monitor 12 for sensing the monitored individual's proximity to a food container with an RFID tag that identifies the contents of the container (e.g., cereal) and when the individual was in the proximity of the food container. After the monitor 12 acquires data from one or more of the personal and environmental sensors, the acquired data is processed by a "nutrition" program or "app" within the monitor. The nutrition program may have access to other data/information that may be relevant to the analysis of the data from the sensors and may not be provided by one or more of the sensors. For example, the nutrition program may have access to historical nutritional data for the monitored individual that facilitates pattern or trend analysis (e.g. is the monitored individual's nutritional intake satisfactory but trending down). If the monitor 12 has insufficient memory to store the relevant historical data and the third party caregiver 16 is appropriately equipped to store such data, historical data can be conveyed to the third party caregiver 16 for storage and recalled as needed by the monitor 12 using the communication interface 26. In any event, the nutritional program assesses the likelihood that the monitored individual has the desired caloric intake and compares the assessed likelihood to the predetermined threshold. It should be appreciated that the assessment may be based on the data provided by a single sensor, data provided by several sensors, and data from multiple sensors with the data from a particular sensor being weighted relative to the data from other sensors. If the assessed likelihood is less than the threshold, no further action is taken other than to continue to monitor the nutritional situation. If, however, the assessed likelihood is equal to or greater than the threshold value, the program causes appropriate action to be taken (e.g., initiate communication with the monitored individual and/or alert a third party). It should be appreciated that a threshold can be used such that no action is taken when the assessed likelihood is less than or equal to the threshold and action is taken when the assessed likelihood exceeds the threshold.

Example 2

Assess battery status of a mobility device (electric chair or car) and ability to return to predetermined location. The environmental sensors include sensors associated with the mobility device. Typically, these sensors sense that the device is in use and the remaining battery life. The personal sensors include a GPS. Also available to mobility device program in the monitor 12 is: (a) a profile or the ability to determine a profile based on historical data associated with the device of the distance that the device can be expected to cover based upon the remaining battery life and (b) a browser capable of accessing a service, like Google Maps, and providing the service with the monitored individual's current GPS location (or other location information) and the predetermined location to which the monitored individual and the mobility device must return. The service identifies the shortest route between the monitored individual's location and the predetermined location and the distance associated with this route. The mobility device program uses the monitored individual's current GPS location, the remaining battery life, profile, and a mapping service to assess whether the individual and their mobility device can likely return to the predetermined location. Based on a comparison of the assessment to a threshold, the mobility device program either takes no further action and continues to monitor the situation, attempts to alert the monitored individual of an impending inability to return to the predetermined location with the mobility device using an output peripheral associated with the user interface 22, or uses the communication interface 26 to alert a third party caregiver that the monitored individual and their mobility device may be stranded and in need of assistance.

Example 3

Assess monitored individual's social interactions. The environmental sensors include a microphone. The personal sensors include a GPS. A social interaction program in the monitor 12 is provided with data from the sensors. Also available to the program is a voice profile for the monitored individual, and/or voice profiles for one or more other individuals with which the monitored individual associates, and/or other data established at setup or at a later time (e.g., schedule of when caregiver is to be with the monitored individual). The social interaction program processes the data provided by the sensors, the voice profile(s), and other data to assess whether the monitored individual is alone or with one more other individuals at a particular time. Further, in the situation in which the monitored individual is associating with another individual, the program can assess whether this association with the other individual is appropriate (e.g., occurring within a specified time frame). For example, the program assesses the data provided by the microphone and a voice print of the monitored individual's caregiver to determine if the caregiver is with the monitored individual at scheduled times. The program compares the assessed likelihood that a particular social situation is or is not occurring to a predetermined threshold. Based on the comparison, the program either takes no action other than to continue to monitor the situation or takes whatever action is appropriate in the situation (i.e., attempt to contact the monitored individual via the user interface 22 and/or contact the third party caregiver 16 via the communication interface 26).

Example 4

Assess whether the monitored individual is an environment that is too hot or too cold for the individual. The environmental sensors include: (a) one or more room/residential temperature sensors and (b) an outdoor temperature sensor. The personal sensors include a GPS. A temperature program associated with the monitor 12 assesses the data from the sensors. Also potentially available to the program is historical temperature data associated with the location of one or more of the temperature sensors. Some or all of this historical data may be retained within the memory of the monitor 12. Alternatively, some or all of this historical data may be retained by an appropriately equipped third party caregiver 16 and available to the program via the communication interface 26. An example of historical temperature data that may be relevant to the assessing a temperature related situation for a monitored individual is historical temperature data associated with a sauna. In any event, data from one or more of the sensors that is received by the sensor system 20 and other relevant data/information from the user interface 22 and other relevant historical data/information is assessed by the temperature program. The program compares the assessment (i.e., likelihood of an adverse temperature situation) to a predetermined threshold value and either takes no action other than to continue monitoring the situation or causes one or more predetermined actions to be initiated by the monitor 12.

Example 5

Assessing whether the monitored individual is in an environment in which a fire is present or imminent. The environmental sensors include: (a) camera, (b) stove sensor for indicating if a gas burner is active and lit, (c) smoke detector, and (d) thermometer. The personal sensors include a position monitoring sensor for indicating whether the monitored individual likely is upright (standing or sitting) or prone. A fire program associated with the monitor 12 processes the data provided by the environmental and personal sensors to assess the likelihood of a fire situation. For example, the fire program may assess: (a) pictures provided by the camera in a room and showing that the air in the room has significant particulates (perhaps smoke) and that the particulate density is increasing, (b) data provided by the stove sensor indicating that a gas burner is "on" and lit, (c) data provided by the smoke detector indicating that the particulates are not smoke or not of sufficient density to trigger an alarm, (d) data provided by the thermometer indicating that the temperature of the room is within normal ranges (either predefined or based on historical data), and (e) the personal sensor indicates that the monitored individual is in a prone position. In assessing the data provided by the various sensors in this example, the fire program may determine that there is a 30% chance of a fire. Upon reaching this determination, the firm program may cause the monitor 12 to initiate a communication with the monitored individual via the user interface 22 to apprise the monitored individual of the potential fire situation and inquire as to whether the monitored individual needs assistance. The monitored individual can then use an input peripheral associated with the user interface 22 to respond. Depending on the monitored individual's response or lack of response, the fire program continues the assessment of the situation. For example, if the monitored individual fails to respond to the attempted communication and the position monitor continues to indicate that the monitored individual is in a prone position, the fire program may now determine that there is 60% chance of a fire or imminent fire. If the predetermined threshold is 50%, the fire program then utilized the communication interface 26 of the monitor 12 to initiate a request or requests for assistance for the monitored individual (e.g., fire department, caregiver, family members etc.). In contrast, if the monitored individual responds to the inquiry in a coherent manner indicating awareness of the situation and ability to deal with the situation, the fire program may take no further action other than to continue monitor the situation. Among the possible ways in which the monitored individual can respond to the inquiry is a verbal message conveyed by a microphone associated with the monitor 12 or a text message conveyed by a keyboard associated with the monitor 12. The fire program can assess the coherency of the verbal message using, for example, a voice/stress analysis program. A text message can be assessed using a semantic and/or syntax analysis program.

Example 6

Assessing whether the monitored individual is deviating from an established pattern. The personal sensors include: (a) a position monitoring sensor for indicating whether the monitored individual likely is upright (standing or sitting) or prone and when the monitored individual transitioned between upright and prone positions and (b) one or more medical sensors (e.g., respiration rate and pulse). A "personal-deviation from normal" program resident in the processing system 24 of the monitor 12 processes the data produced by the personal sensors to assess whether the monitored individual is deviating from a normal situation. Also available to the program is historical data indicative of when the monitored individual transitions between upright and prone positions. For example, the personal-deviation program might assess: (a) data provided by the position sensor indicating that a monitored individual is in a prone position at 10 a.m. and (b) data provided by the respiration and pulse sensors indicating that the monitored individual's respiration and pulse are within normal ranges relative to historical data. In assessing the data provided by the sensors, the program may determine, based on the current position data (i.e., prone at 10 a.m.) and the historical position date for the monitored individual (mostly upright at 10 a.m.), that the prone position at 10 a.m. is a significant deviation from the normal, upright position at 10 a.m. Further, the assessment by the program might indicate that there is a 30% that the monitored individual is in a situation or potentially facing a situation in which assistance may be needed. The program utilizes an output peripheral associated with the user interface 22 to initiate a communication with the monitored individual. Depending upon the monitored individual's response or lack of response, the program either take no further action but continues to monitor the situation or initiates a communication with the third party caregiver 16 to obtain assistance for the monitored individual.

Example 7

Assessing whether a parameter associated with the monitored individual's residential environment is deviating from an established pattern. The environmental sensors include: (a) a thermometer associated with a living area of the monitored individual's residence, (b) a water flow monitor associated with a water tap in the residence and capable of indicating whether or not water is flowing from the tap and when water began flowing and ceased flowing from the tap, (c) stove/range sensors for indicating whether or not gas is flowing to the stove/range, whether or not a gas burning element is lit, and when the gas began flowing and ceased flowing to a gas burning element, (d) television sensors for indicating whether or not a television is "on," when the television was turned "on" and when the television was turned "off," the channel to which the television is tuned, the volume setting of the television. An "environmental-deviation from normal" program processes the data provided by the sensors to assess whether there is a deviation in the environment of the monitored individual. Also available to the program is historical data indicative relating to the data produced by one or more of the sensors. For example, historical data may indicate that the monitored individual regularly watches a particular game show that is shown on a specific channel at the same time every weekday. The environmental-deviation from normal program is capable of assessing numerous possible situations. For example, the program can assess based on sensor data, historical data (if available) and/or other data provided during setup or at a later time, whether the bath water has been running longer than required to fill a tub, whether the temperature in a room is higher or lower than is normal for the time of day and the time of year, and whether a gas burner is turned "on" and bath water running at the same time. Numerous other situations that are either incongruous or deviations from normal can potentially be assessed. In any event, the program compares the assessment for a particular situation to a threshold for that situation and takes the appropriate action based on the comparison (e.g., do nothing a continue to monitor, initiate a communication with the monitored individual via the user interface 22, or initiate a communication with the third party caregiver 16 using the communication interface 26).

The foregoing description of the invention is intended to explain the best mode known of practicing the invention and to enable others skilled in the art to utilize the invention in various embodiments and with the various modifications required by their particular applications or uses of the invention.

What is claimed is:

1. A portable monitoring device for use by an elderly/infirm individual that desires a significant degree of independence, the portable device comprising:

a sensor system for receiving sensor data from a wireless sensor, the sensor data relating to an environment surrounding an elderly/infirm individual;

a user interface for providing an elderly/infirm individual with the ability to interact with the device, the user interface comprising an input peripheral for providing an elderly/infirm individual with the ability to input data/information and a output peripheral for providing an elderly/infirm individual output data/information that can be sensed;

a processing system for processing sensor data from the sensor system and/or input data/information from the input peripheral; and a communication interface for sending data/information relating to an elderly/infirm individual to a third party;

wherein the processing system is adapted to cause the communication interface to direct to a third party (a) certain sensor data identified by the processing system and/or (b) certain data/information derived from sensor data and identified by the processing system;

wherein the input peripheral of the user interface allows an elderly/infirm individual to create a signal for processing by the processing system to control at least one of the sensor system with respect to a wireless sensor and the communication interface with respect to data/information received or derived from a wireless sensor so as to prevent sensor data from a wireless sensor and/or data/information derived from the processing of sensor data from a wireless sensor from potentially being sent to a third party by way of the communication interface;

wherein the sensor system, user interface, processing system, and communication interface are operatively coupled together into a unit that has a weight and dimensions that allow the unit to be carried on or associated with the person of a typical elderly/infirm individual without substantially impeding the individual's ability to move.

2. A portable monitoring device, as claimed in claim 1, wherein:

the processing system for processing sensor data from the sensor system and/or input data/information from the input peripheral to determine if an elderly/infirm individual is in a situation or likely to be in a situation in which the elderly/infirm individual would likely need assistance from another individual.

3. A portable monitoring device, as claimed in claim 1, wherein:

the processing system for processing sensor data from the sensor system and/or input data/information from the input peripheral to assess the likelihood that an elderly/infirm individual is in a particular situation and comparing the assessed likelihood to a threshold value to determine if the individual is in a situation or likely to be in a situation in which the elderly/infirm individual would likely need assistance from another individual.

4. A portable monitoring device, as claimed in claim 2, wherein:

the processing system, after determining an elderly/infirm individual is in a situation or likely to be in a situation in which the elderly/infirm individual would likely need assistance from another individual, for using an output peripheral of the user interface to inform the elderly/infirm individual of the determination relating to the situation and requesting that the elderly/infirm individual indicate: (a) their awareness of the situation and/or (b) whether assistance from another individual is needed.

5. A portable monitoring device, as claimed in claim 1, wherein:

the user interface for providing an elderly/infirm individual with the ability to deactivate the monitoring device when the elderly/infirm individual desires not to be monitored.

6. A portable monitoring device, as claimed in claim 1, wherein:

the signal is a deactivation signal relating to one or more wireless sensors;

the processing system is adapted to receive a deactivation signal relating to one or more wireless sensors, process the deactivation signal, and transmit a sensor system deactivation signal to the sensor system identifying one or more wireless sensors to be deactivated; and the sensor system adapted to receive a sensor system deactivation signal, process the sensor system deactivation signal, and transmit a wireless sensor deactivation signal to each of the one or more wireless sensors identified for deactivation by the use of the user interface.

7. A portable monitoring device, as claimed in claim 1, wherein:

the processing system is capable of causing the sensor system to acquire data from one or more active wireless sensors and process the acquired data.

8. A portable monitoring device, as claimed in claim 1, wherein:

the signal is a disable sensor system signal relating to one or more wireless sensors;

the processing system is adapted to receive a disable sensor system signal relating to one or more wireless sensors, process the disable sensor system signal, and transmit a sensor system disable signal to the sensor system identifying one or more wireless sensors whose signals should not be processed by the sensor system; and the sensor system adapted to receive a sensor system disable signal and process the sensor system disable signal so that the sensor system does not process the signal from each wireless sensors identified in the sensor system disable signal.

9. A portable monitoring device, as claimed in claim 1, wherein:

the signal is a disable processing system signal relating to one or more wireless sensors; and the processing system adapted to receive a disable processing system signal relating to one or more wireless sensors and process the disable processing system signal so that the processing system does not process data/information provided by the sensor system that relates to each of the wireless sensors identified in the disable processing system signal.

10. A portable monitoring device, as claimed in claim 1, wherein:

the signal is a disable communication interface signal relating to one or more wireless sensors; and the processing system adapted to receive a disable communication interface signal relating to one or more wireless sensors and process the disable communication interface signal so that the processing system does not provide data/information relating to the one or more wireless sensors identified in the disable communication interface signal from being provided to the communication interface.

* * * * *